United States Patent [19]

Kjaer et al.

[11] 4,356,747

[45] Nov. 2, 1982

[54] DEVICE FOR SIMULTANEOUSLY CUTTING A PLURALITY OF WRAPPERS FROM A TOBACCO LEAF

[75] Inventors: Ian Kjaer, Hadsund; Hans J. Moller, Harlev, both of Denmark

[73] Assignee: Skandinavisk Tobakskompagni A/S, Søborg, Denmark

[21] Appl. No.: 246,860

[22] Filed: Mar. 23, 1981

[30] Foreign Application Priority Data

Mar. 27, 1980 [DK] Denmark ..... 1323/80

[51] Int. Cl.[3] ..... A24C 1/00

[52] U.S. Cl. ..... 83/451; 83/510; 83/520; 83/522; 83/658; 269/11

[58] Field of Search ..... 83/451, 510, 511, 512, 83/520, 522, 652, 658; 269/11

[56] References Cited

U.S. PATENT DOCUMENTS 4,226,148 10/1980 Logan ..... 83/451

*Primary Examiner*—James M. Meister

*Attorney, Agent, or Firm*—Stevens, Davis, Miller & Mosher

[57] ABSTRACT

A cutting table for whole tobacco leaves out of which wrappers or binders are to be cut, comprises a perforated plate forming the top of a suction box and presenting a field illuminated from below, within which the mid rib of the tobacco leaf should be positioned, and also presenting indication lines likewise set off by illumination to facilitate the optimum position of the tobacco leaf in relation to the desired cutting pattern.

1 Claim, 1 Drawing Figure

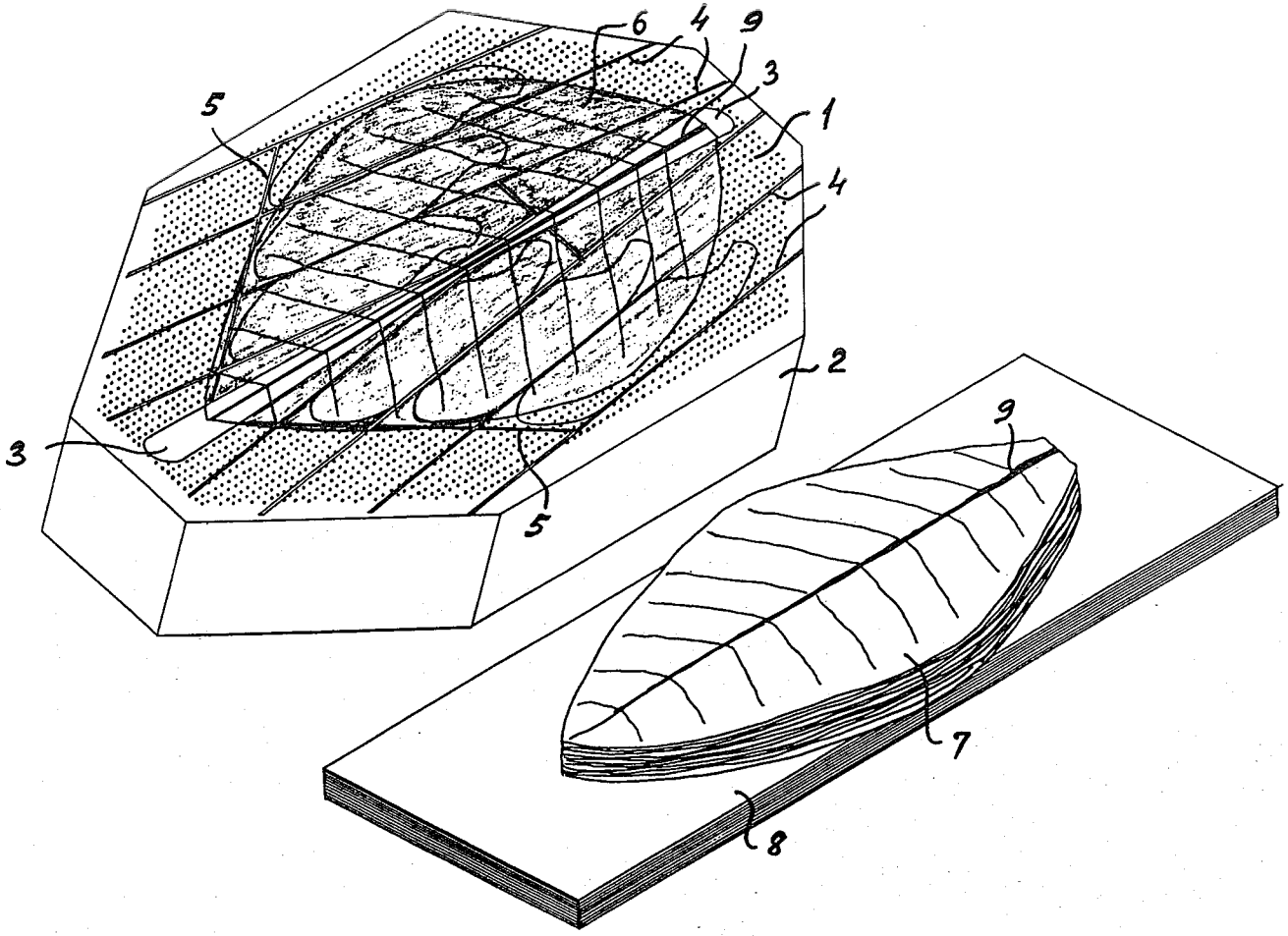
1
2
3
4
5
6
7
8
9

DEVICE FOR SIMULTANEOUSLY CUTTING A PLURALITY OF WRAPPERS FROM A TOBACCO LEAF

BACKGROUND OF THE INVENTION

In the production of cheroots and similar rolled tobacco articles its is common practice to make use of a combined spread- and cutting table on which a stripped tobacco leaf is held by suction after having been positioned as desired in relation to the cutting knife. A roller is subsequently moved across said knife to cut a wrapper out which by a pivot arm provided with a suction head is transferred to a roller mechanism in which the wrapper is applied to a prepared bunch. If desired, two or more wrappers can be cut out successively from each half of the tobacco leaf and the operator is then obliged, prior to the cutting operation, to position the tobacco leaf in such a manner on the table that the desired number of wrappers may be produced with due regard to possible holes or other defects in the tobacco leaf and to the location of its side ribs.

It is also known to perform the cutting in whole or half tobacco leaves independently of the overrolling. The wrappers may then be collected in bobbins for later use, but in this case too, the operator must be careful about positioning the tobacco leaves so as to reduce waste to a minimum. In this respect the operator's only aid is generally the cutting knife the location of which can be seen on the surface of the tobacco leaf after vacuum has been applied to hold the leaf, but at that time the positioning cannot be changed or corrected unless the vacuum is suspended. It is further possible, in particular by use of spread-tables without cutting knife, to mark the cutting pattern or other indications on the spread-table, but this is neither a satisfactory solution because such indications or at least considerable parts of them are hidden by the tobacco leaf as placed on the table.

The above mentioned drawback has been eliminated by a device known from DE-AS No. 1,188,995 and intended for cutting wrappers or binders one by one from tobacco leaves placed on a cutting table which is illuminated in a pattern corresponding to the contour of the wrapper or binder to be cut out. For this purpose a templet may be mounted between the top side of the table and a source of parallel light beams, the contour of said templet being identical with the cutting pattern so that the tobacco leaf is illuminated in a field contoured exactly as this pattern, or a light source may be provided below the table and surrounded by its movable knife to illuminate the field from below within the contour of the knife so that this field becomes visible through the tobacco leaf as laid.

With a view to obtaining an optimum output of tobacco leaves, and for the relief of the operator, a technique has further been developped that makes use of several cutting knives the position of which is controlled by a scanning picture of the tobacco leaf, see for instance the published specification of British patent application No. 2,015,865. In this case the tobacco leaf is placed arbitrarily on a light-translucent table and while being transilluminated from below the leaf is being scanned so as to produce a picture illustrating the positioning of the periphery and ribs of the leaf and revealing possible defects such as holes or discolorations. From said picture the positioning of the cutting knives is controlled in such a manner that only usable sections of the leaf will form part of the wrappers or binders resulting from the cutting operation. This technique requires, however, vast investments and due to the positioning or adjusting movement of the knives the rate of production will scarcely be sufficiently high to justify such investments.

PURPOSE AND SUMMARY OF THE INVENTION

In connection with a multiple cut process, i.e. when at least two wrappers or binders are cut out in the same stroke, it is a purpose of the present invention to solve the problem of positioning without need for appreciable extra-investments and without eliminating the manual work, but so as to considerably facilitate and accelerate such work.

More particularly, this invention relates to a device for simultaneously cutting a plurality of wrappers or binders or blanks therefor from a tobacco leaf and comprising a cutting table with an indication, made visible by illumination from below, to facilitate the optimun positioning of the tobacco leaf in relation to the cutting pattern and on which the tobacco leaf is held by suction through perforations provided in the table. According to the invention the said purpose is fulfilled by the feature that the table comprises light-translucent portions forming, firstly, a central, elongated field having the contour of a slender hourglass and, secondly, two systems of straight lines on opposite sides of said field, the lines of each system being parallel and having a spacing similar to the width of the blanks to be cut out and a direction forming a small angle with the centre line in the central field.

The desired cutting pattern normally leaves a certain margin for the positioning of the tobacco leaf, but it should under any circumstance be ensured that at least the thicker portions of the mid rib are not included in the parts to be cut out. This main condition is easily fulfilled by using the device concerned, because the central, hourglass-shaped field directly indicates the allowable area for the location of the mid rib and thus clearly shows to the operator the degree of latitude allowed for displacing the tobacco leaf with a view to avoiding defects in the wrappers and binders. In this respect the two systems of straight lines constitute an appreciable aid because they make it possible for the operator to discover whether any defects at a given location of the tobacco leaf lie within the cutting contours so that the positioning should be changed by displacing the leaf to obtain the optimum result. The leaf is subsequently fixed by providing a suitable vacuum or by intensifying a vacuum already provided, following which the cutting operation can be carried out either by means of knives built into the cutting table or by using the table as cutting base or bed.

BRIEF DESCRIPTION OF THE DRAWING

The drawing shows a perspective view of the novel device together with an associated store-table for tobacco leaves to be cut into wrappers or binders.

DETAILED DESCRIPTION OF THE PREFERRED EMBODIMENT

In the illustrated embodiment the cutting table comprises a perforated plate 1 forming the top side of a box 2 provided with one or more light sources, not shown, and in which a preferably variable vacuum may be established in a generally known manner. The plate 1 has a contour corresponding very roughly to the circumference of the largest tobacco leaves to be processed and is mainly opaque apart from a field 3 extending along the centre line of the plate, and two systems of parallel lines 4 located on either side of the field 3 and serving as aids when positioning a tobacco leaf 6 on the table, said lines indicating the strips of the leaf within which the wrappers and binders will be cut out.

The optimum output of the tobacco leaf normally implies that the foremost ends of the cuts are placed close to the leaf edge at its point end, and the optimum location of the leaf 6 in that respect is indicated by the illuminated oblique strokes or lines 5.

The tobacco leaves are taken separately from the top of a pile 7 on a storetable 8 and the leaf is drawn across the perforated plate 1 until its mid rib 9 lies within the illuminated control field 3. During this operation a light vacuum may be maintained in the box 2 so that the leaf 6 adheres to the plate 1 but may still be displaced thereon without difficulty.

Contour lines indicate a desired cutting pattern that is meant to produce three wrappers or binders on either side of the mid rib, but in this case the two uttermost ones are, however, inapplicable because they extend beyond the outer edge of the tobacco leaf 6. A better output of the leaf could evidently be obtained by choosing another size of at least one of the cuts for each half of the leaf. It is seen that the four remaining cuts leave a certain margin or latitude as far as their location on the tobacco leaf 6 is concerned, thus permitting the tobacco leaf to be displaced, even angularly, within certain limits, until the operator estimates the cutting result to be optimum. The limits to moving about are indicated by the illuminated field 3 that is shaped like a slender hourglass. This is due to the fact that a possible angular displacement of the leaf 6 generally should be effected about a point near its centre.

We claim:

1. A device for simultaneously cutting a plurality of wrappers or binders or blanks therefor from a tobacco leaf and comprising a cutting table with an indication made visible by illumination from below to facilitate the optimum positioning of the tobacco leaf in relation to the cutting pattern, and on which the tobacco leaf is held by suction through perforations provided in the table, wherein the table comprises light-translucent portions forming, firstly, a central, elongated field having the contour of a slender hourglass and, secondly, two systems of straight lines on opposite sides of said field, the lines of each system being parallel and having a spacing similar to the width of the blanks to be cut out and a direction forming a small angle with the centre line in the central field.

* * * * *